United States Patent [19]

Landry et al.

[11] Patent Number: 4,458,229

[45] Date of Patent: Jul. 3, 1984

[54] DISPERSION CORRECTING WAVEGUIDE

[75] Inventors: Norman R. Landry, Mount Laurel; Leonard H. Yorinks, Cherry Hill, both from N.J.

[73] Assignee: RCA Corporation, New York, N.Y.

[21] Appl. No.: 331,899

[22] Filed: Dec. 17, 1981

[51] Int. Cl.[3] ..... H01P 5/00

[52] U.S. Cl. ..... 333/248; 333/157

[58] Field of Search ..... 333/28 R, 157, 239, 333/248, 159

[56] References Cited

U.S. PATENT DOCUMENTS 2,599,753 6/1952 Fox ..... 333/34 X

FOREIGN PATENT DOCUMENTS 597258 1/1948 United Kingdom ..... 333/159

OTHER PUBLICATIONS

Simons, *Fin Line with a Variable Characteristic*, Proc. of the IEEE, vol. 68, No. 1, Jan. 1980, pp. 170, 171.

*Primary Examiner*—Paul L. Gensler

*Attorney, Agent, or Firm*—Joseph S. Tripoli; Robert L. Troike; Robert Ochis

[57] ABSTRACT

A waveguide dimensioned for fundamental mode operation over a given frequency range is rendered substantially dispersionless by including within the waveguide a thin dielectric slab extending parallel to the E-field of the fundamental mode and having a dielectric constant of at least 4 and a thickness across the E-field ranging between 0.01 and 0.25 guide wavelengths at the center frequency of the given range. Appropriate thicknesses for a dielectric member having a given dielectric constant can be selected to provide overcompensation. The series connection of appropriate lengths of an overcompensated waveguide and uncompensated waveguide yield an overall waveguide having a substantially dispersionless characteristic.

5 Claims, 7 Drawing Figures

DISPERSION CORRECTING WAVEGUIDE

Figure 1:
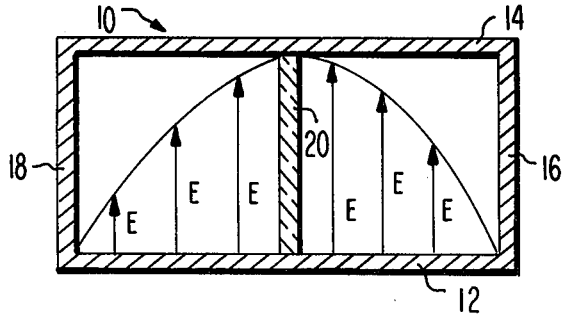

This invention relates to the field of waveguides and more particularly to the correction of dispersion within waveguides.

The propagation characteristics of an electromagnetic wave within a waveguide vary with the frequency of the wave. In particular, different frequencies propagate at different velocities within a given waveguide. This causes signals of different frequencies which are in phase at one point in a waveguide to become progressively further out of phase the further they get from the in-phase point. This effect is known as dispersion. In a given waveguide, the greater the difference in frequency between two signals, the more rapidly they disperse (get out of phase) with distance of propagation along the waveguide. Consequently, more dispersion is introduced into wide-band signals propagating within a waveguide than is introduced into a narrow-band signal propagating within the same waveguide. Dispersion results in distortion of the shape of pulses and other signals which involve a range of frequencies. The amount of distortion introduced into a signal increases both with increasing signal bandwidth and increasing propagation distance within a dispersive waveguide.

In many applications, especially in wide-band systems, dispersion is detrimental to system performance because the system depends on signal characteristics such as pulse shape which are distorted by dispersion.

The use of wide-band signals is becoming more common in communications and radar systems. As a result there is an increasing need for waveguides which have reduced dispersion or are non-dispersive in order to maximize system performance in very wide-band systems which operate at frequencies which are high enough that waveguides are used for signal propagation.

In accordance with the preferred embodiment of the invention, a waveguide dimensioned for fundamental mode operation over a given range of frequencies is rendered substantially less dispersive by including in the waveguide a (flat) dielectric member having its major surfaces extending parallel to the E-field of the fundamental mode and parallel to the direction of propagation. The dielectric member has a dielectric constant of at least 4 and a thickness across the E-field in the range between 0.01 and 0.25 guide wavelengths. The thickness of the dielectric is selected from within this range to provide a substantial reduction in dispersion within the waveguide over the given range of frequencies. A dielectric member of a given composition may be of one thickness and extend the full length of the waveguide or may be of a different thickness and extend only part of the length of the waveguide while providing similar dispersion compensation for proper selection of the two thicknesses.

Figure 2:
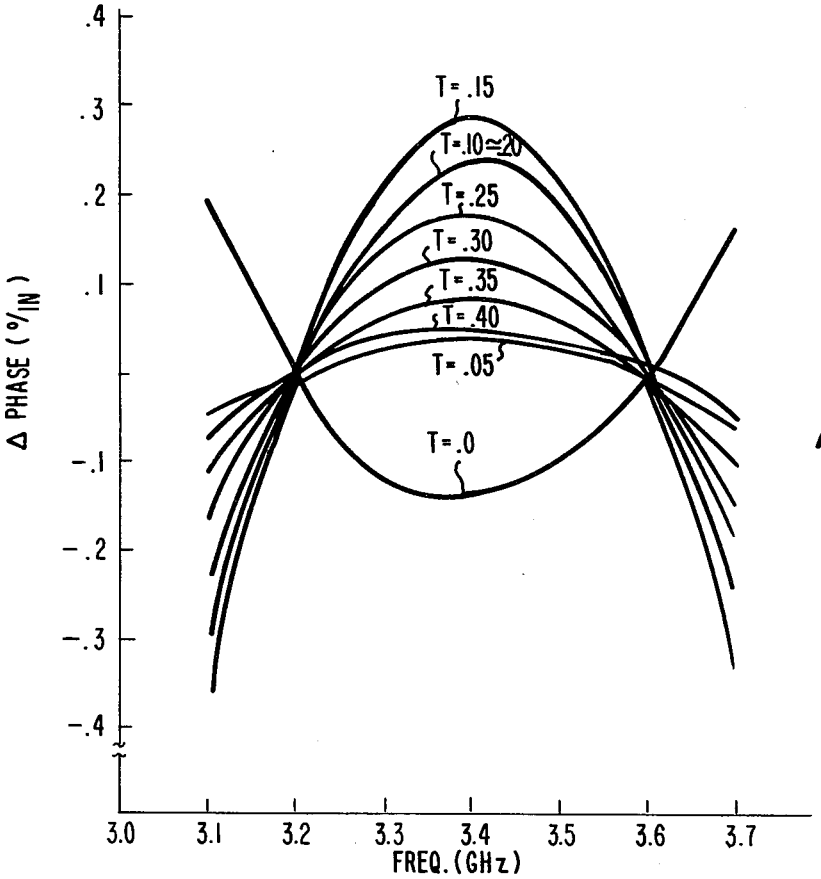
Figure 3:
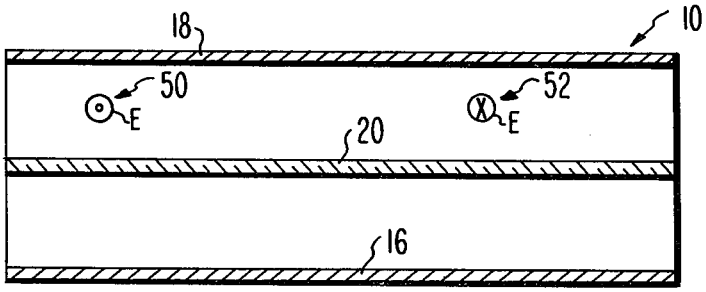
Figure 5:
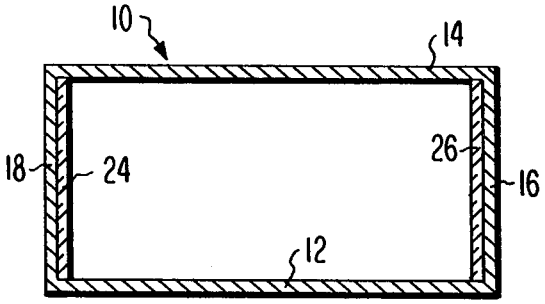
Figure 6:
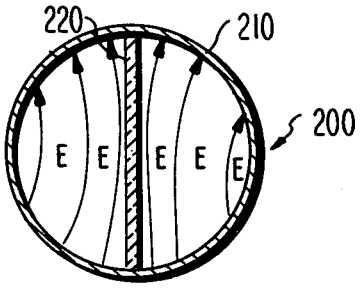
Figure 7:
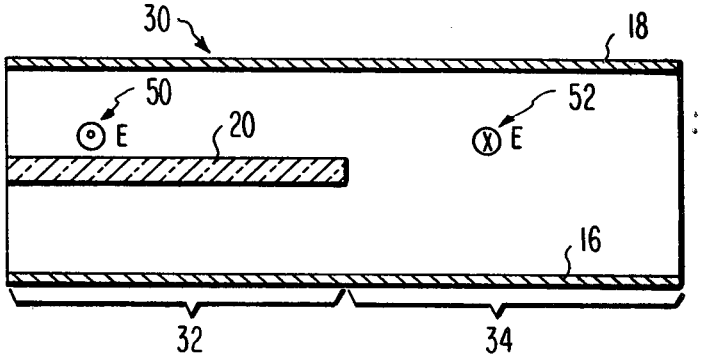

In the drawing:

FIGS. 1, 4, 5 and 6 are end views of a waveguide in accordance with the present invention, FIG. 2 is a graph of the deviation from linear phase of the phase versus frequency characteristics of the waveguide of FIG. 1 as a function of the thickness of the dielectric, FIG. 3 is a top, cutaway view of one embodiment of the invention, FIG. 7 is a top cutaway view of another embodiment of the invention.

In FIG. 1 a rectangular waveguide 10 designed for $LSE_{10}$ operation over a given designed range of frequencies is illustrated in end view. The waveguide 10 has parallel broad walls 12 and 14 spaced apart by parallel narrower walls 16 and 18. A thin, flat dielectric member 20 is disposed within the waveguide extending between and contacting the broad walls 12 and 14. The flat surfaces of dielectric member 20 are thus disposed parallel to the E-field of the fundamental mode electromagnetic wave in this waveguide and its thickness extends across (perpendicular to) the E-field. This rectangular waveguide may be square if desired, in which case the broadwalls 12 and 14 and the "narrower" walls 16 and 18 all have the same width. In the embodiment illustrated in FIG. 1, dielectric member 20 is centered between the narrow walls 16 and 18. The dielectric body 20 has a dielectric constant of at least 4 and a thickness in the range between 0.01 and 0.25 guide wavelengths within the waveguide 10 at the center frequency of the designed operating band of the waveguide. In general, the higher its dielectric constant is, the thinner the body 20 will be to provide the desired dispersion compensation. The separation between the broad walls 12 and 14 of the waveguide is preferably approximately one quarter guide wavelength and the separation between the narrow walls 16 and 18 is preferably about half a guide wavelength, both at the center frequency of the designed range within the waveguide. Thus, the thickness of dielectric 20 is between 2% and 50% of the width of the waveguide.

The presence of the slab 20 of dielectric material within the waveguide has the effect of reducing the dispersion of the waveguide if the thickness of a member 20 is properly chosen in accordance with its dielectric constant. As the thickness of the dielectric member 20 increases beyond a certain value (which depends on its dielectric constant) the member's dispersion reduction effect decreases. At a limiting thickness which depends on its dielectric constant, member 20 ceases to provide any dispersion reduction effect. The limiting thickness decreases with increasing dielectric constant.

FIG. 2 illustrates the deviation from linear phase of the phase versus frequency characteristic of a waveguide 10 over the frequency range 3.1–3.7 GHz as a function of the thickness of its dielectric member 20 which has a dielectric constant of 16. This waveguide has a width of 2.84 inches (7.21 centimeters) and a height of 0.67 inches (1.7 centimeters). When the dielectric member has a zero thickness and thus is absent, the waveguide has a substantially concave (positive curvature) deviation from a linear phase versus frequency characteristic and thus is dispersive over the 3.1 to 3.7 GHz frequency range. For thicknesses (T) of dielectric member 20 in the range from about T=0.04 inches (0.10 centimeters) to about T=0.45 inches (1.14 centimeters) the deviation of the phase versus frequency characteristic from linear phase has a convex shape (negative curvature). For dielectric member 20 thicknesses greater than about 0.45 inches (1.14 centimeters), the waveguide's deviation from a linear phase versus frequency characteristic returns to concave (positive curvature) configuration. For this particular dielectric constant (16), this waveguide is substantially dispersionless for a dielectric member 20 which extends the full length of the waveguide as shown in FIG. 3 when the member 20 has a thickness of about 0.04 inches (0.10 centimeters) or about 0.45 inches (1.14 centimeters). These thicknesses are equal to 1.4% and 15.8% the waveguide's width, respectively. In FIGS. 3 and 7 the circle with a dot in it identified by reference number 50 indicates an E-field line extending vertically out of the paper toward the observer and the circle with an x in it identified by reference number 52 indicates an E-field line extending vertically down into the paper away from the observer. The dot circle 50 and the x circle 52 are an odd number of half wavelengths apart in the direction of propagation.

Figure 4:
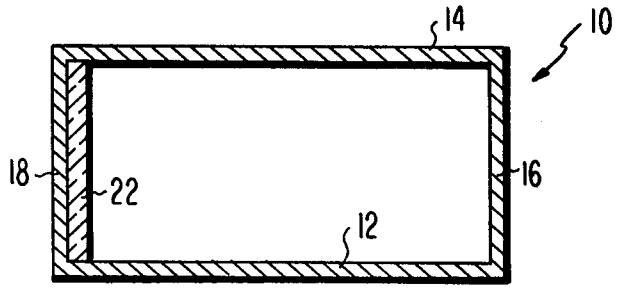

The total thickness of the dielectric material 20 may be a single slab positioned in the center of the waveguide as illustrated in FIG. 1, located against one wall of the waveguide as indicated at 22 in FIG. 4, divided into two pieces—one along each of the narrower walls of the waveguide as illustrated in FIG. 5 at 24 and 26 or distributed in some other manner.

The most effective means of selecting an advantageous combination of dielectric constant and dielectric thickness for a given application is through the use of computer aided design using a program which determines the propagation constants of a waveguide as a function of its loading and the frequencies to be propagated in the waveguide.

In FIG. 6 a circular waveguide 200 having a wall 210 has a flat, thin dielectric slab 220 disposed along a diameter of waveguide 200 parallel to the E-field of a fundamental mode ($TE_{11}$) electromagnetic wave which will propagate in that waveguide. This slab has the same dispersion reduction effects as slab 20 has in waveguide 10 for properly selected slab thicknesses and dielectric constants.

The use of a uniform slab 20 extending the full length of the waveguide as shown in FIG. 3 and having a thickness to yield a substantially dispersionless waveguide is beneficial for long lengths of waveguide, but is not optimum for waveguides including such prefabricated parts as directional couplers, circulators and phase shifters which would create significant difficulties in attempts to render them dispersive. A waveguide 30 comprising a section of overcompensated waveguide 32 (one having a convex phase versus frequency characteristic (about the linear term) in FIG. 2) in series with a section of uncompensated waveguide 34 is shown in a top section view in FIG. 7. For properly selected section lengths and dielectric member thicknesses and dielectric constant, the overall waveguide 30 can be rendered substantially dispersionless over a designed operating frequency range. This eliminates any need to modify complicated waveguide components such as directional couplers, etc. The waveguide sections 32 and 34 may have different dimensions and are impedance matched across their transition to minimize reflections and other disturbances in the propagation of electromagnetic waves therethrough. Referring to the phase versus frequency characteristics illustrated in FIG. 2, it can be seen that a section 32 of the rectangular waveguide of FIG. 1 having a dielectric member thickness of about 0.30 inches (0.76 centimeters) and a dielectric constant of 16 when connected in series with an uncompensated equal length section 34 of waveguide having the same dimensions will yield a substantially dispersion-compensated waveguide 30 having a substantially flat phase versus frequency characteristic in FIG. 2. In this manner, the length of such prefabricated parts as directional couplers, circulators and phase shifters may be included as part of the specified length of the uncompensated waveguide section 34 thus avoiding the problem of attempting to compensate these complicated components. Ratios of the overcompensated section length to the uncompensated section length other than 1 to 1 may be utilized to provide an overall substantially dispersion compensated waveguide 30 so long as an appropriate dielectric thickness, dielectric constant combination is selected for the compensating dielectric in the overcompensated section 32.

What is claimed is:

1. A transmission system for propagation of electromagnetic waves of a given frequency range comprising:

first and second waveguide portions connected in series and having first and second lengths, respectively, each of said waveguide portions being dimensioned for fundamental mode operation over said given frequency range, each of said waveguide portions, when empty, being dispersive over said given frequency range and having a phase versus frequency characteristic over said given frequency range which deviates from linear and whose deviation from linear has a curvature of one sign;

dispersion reduction means comprising an elongated dielectric member disposed within said second waveguide portion with its long dimension extending the length of said portion along the direction of propagation, said dielectric member extending parallel to the direction of the E-field of said fundamental mode electromagnetic wave, said dielectric member having a dielectric constant of at least 4 and a thickness across said E-field in combination with said second length to provide said second portion with a phase velocity versus frequency characteristic over said given frequency range whose deviation from linear has a curvature of an opposite sign to that of the phase velocity versus frequency charactertistic of said first waveguide portion over said given frequency range whereby the series connection of said first portion and said second portion has a substantially reduced dispersion as compared to the dispersion of said series connection when both waveguides are empty.

2. The system recited in claim 1 wherein:

said first waveguide portion and said second waveguide portion have the same interior dimensions.

3. The system recited in claim 1 wherein:

said first length is the same as said second length.

4. The transmission system recited in claim 1 wherein:

said thickness of said dielectric member is from 0.01 to 0.25 guide wavelengths at the center frequency of said given range.

5. The transmission system recited in claim 1 wherein:

said waveguide is rectangular.

* * * * *